US005551395A

United States Patent [19]

Isaacs et al.

[11] Patent Number: 5,551,395

[45] **Date of Patent: *Sep. 3, 1996**

[54] CONTROL SYSTEM FOR POWER TOOL WITH INTERNAL COMBUSTION ENGINE

[75] Inventors: Claudia A. Isaacs; Keith M. Schorr, both of Charlotte, N.C.

[73] Assignee: Homelite, Inc., Charlotte, N.C.

[ * ] Notice: The term of this patent shall not extend beyond the expiration date of Pat. No. 5,492,096.

[21] Appl. No.: 273,729

[22] Filed: Jul. 12, 1994

[51] Int. Cl.[6] ..... F02D 11/04; F02N 11/00; F02N 17/08

[52] U.S. Cl. ..... 123/339.13; 123/179.3; 123/182.1; 123/403; 123/DIG. 11; 56/10.5

[58] Field of Search ..... 123/179.3, 339.13, 123/396, 398, 182.1, DIG. 11, 179.18, 179.16, 403; 56/10.5, 10.8

[56] References Cited

U.S. PATENT DOCUMENTS

| | | | |
|---|---|---|---|
| 1,862,006 | 6/1932 | Collins | 123/179.16 |
| 2,742,380 | 4/1956 | Peters | 123/182.1 |
| 3,538,899 | 11/1970 | Burkett | 123/182.1 |
| 3,774,303 | 11/1973 | Burkett et al. | 123/182.1 |
| 3,782,354 | 1/1974 | Tuckey | 123/182.1 |
| 4,204,384 | 5/1980 | Holtermann | 56/10.5 |
| 4,217,796 | 8/1980 | Donohue | 477/111 |
| 4,619,228 | 10/1986 | Liu | 123/182.1 |
| 4,807,580 | 2/1989 | Clark | 123/398 |

OTHER PUBLICATIONS

Patent Abstracts Of Japan, vol. 10, No. 253 (M-512), Aug. 29, 1986 for JP-A-61 081528 (Honda Motor Co. Ltd.).

Patent Abstracts Of Japan, vol. 6, No. 207 (M-165), Oct. 19, 1982 for JP-A-57 113963 (Yamaha Hatsudoki KK).

Owner's Manual, Tanaka Auto-Start Brush Cutter AST-5000, 2 pages, 1993.

*Primary Examiner*—Andrew M. Dolinar

*Attorney, Agent, or Firm*—Perman & Green

[57] ABSTRACT

A string trimmer with a control system for electric start, throttling, compression release, and engine kill control. An interlock is provided for preventing a start switch from being actuated unless the throttle trigger is fully actuated to a throttle fully open position. An idle setting system and engine kill button is provided at a control section at the throttle trigger. A single control cable is used for throttling, actuation of a compression release system at the engine, and stopping the operation of the engine.

17 Claims, 7 Drawing Sheets

CONTROL SYSTEM FOR POWER TOOL WITH INTERNAL COMBUSTION ENGINE

BACKGROUND OF THE INVENTION

1. Field of the Invention

The present invention relates to internal combustion engines and, more particularly, to a control system for an internal combustion engine.

2. Prior Art

Power tools, such as the Tanaka AST-5000 Brush Cutter, are known in the prior art that use an electric starter with a start button near a throttle lever. U.S. Pat. No. 4,204,384 discloses an outlet port in an engine block with a closure member controlled by a cable and an on-off switch. U.S. Pat. No. 2,742,380 discloses a starting system for a two-cycle gas engine with a valve for relieving compression. U.S. Pat. No. 4,619,228 discloses an automatic compression release with a diaphragm controlled by crankcase pressure. Other relevant U.S. Pat. Nos. include 3,538,899; 3,782,354; and 4,217,796.

SUMMARY OF THE INVENTION

In accordance with one embodiment of the present invention, in a string trimmer having an internal combustion engine, a throttle actuator, an electric starter and a start switch, the improvement comprises means for preventing the start switch from being actuated unless the throttle actuator is located at a fully actuated position.

In accordance with another embodiment of the present invention, in a power tool having an internal combustion engine with a throttle valve, and a throttle valve control system having a user actuated throttle lever and a control link between the throttle valve and the throttle lever, the improvement comprises a throttle lever control member movably connected to the throttle lever. The throttle lever control member has a first position relative to the throttle lever for adjustably stopping movement of the throttle lever in a pre-determined direction at an idle position. The throttle lever control member also has a second throttle lever release position for allowing the throttle lever to move past the idle position in the predetermined direction to an engine stop position.

In accordance with another embodiment of the invention, a string trimmer is provided having a user control section on a shaft of the trimmer. The control section includes a housing and a throttle actuator movably connected to the housing. The throttle actuator is adapted to be actuated by a user. The control section also includes means for adjustably limiting the position of the throttle actuator on the housing while at an idle position, and means for allowing the throttle actuator to move beyond the idle position to an engine choke position.

In accordance with another embodiment of the invention, in a power tool having a user control section, an internal combustion engine with a throttle valve, and a compression release system, the improvement comprises a single control cable connected between the control section and the engine. The cable is adapted to control the position of the throttle valve, actuation of the compression release system, and stopping of the engine.

In accordance with another embodiment of the present invention, a string trimmer is provided comprising an internal combustion engine having a throttle valve, and a control system. The control system has a throttle actuator, a control cable operably connected between the throttle actuator and the throttle valve for controlling speed of the engine, and means for actuating a first auxiliary function on the engine when the cable is moved to a first pre-determined position.

BRIEF DESCRIPTION OF THE DRAWINGS

The foregoing aspects and other features of the invention are explained in the following description taken in connection with the accompanying drawings, wherein.

DETAILED DESCRIPTION OF THE PREFERRED EMBODIMENT

Figure 1:
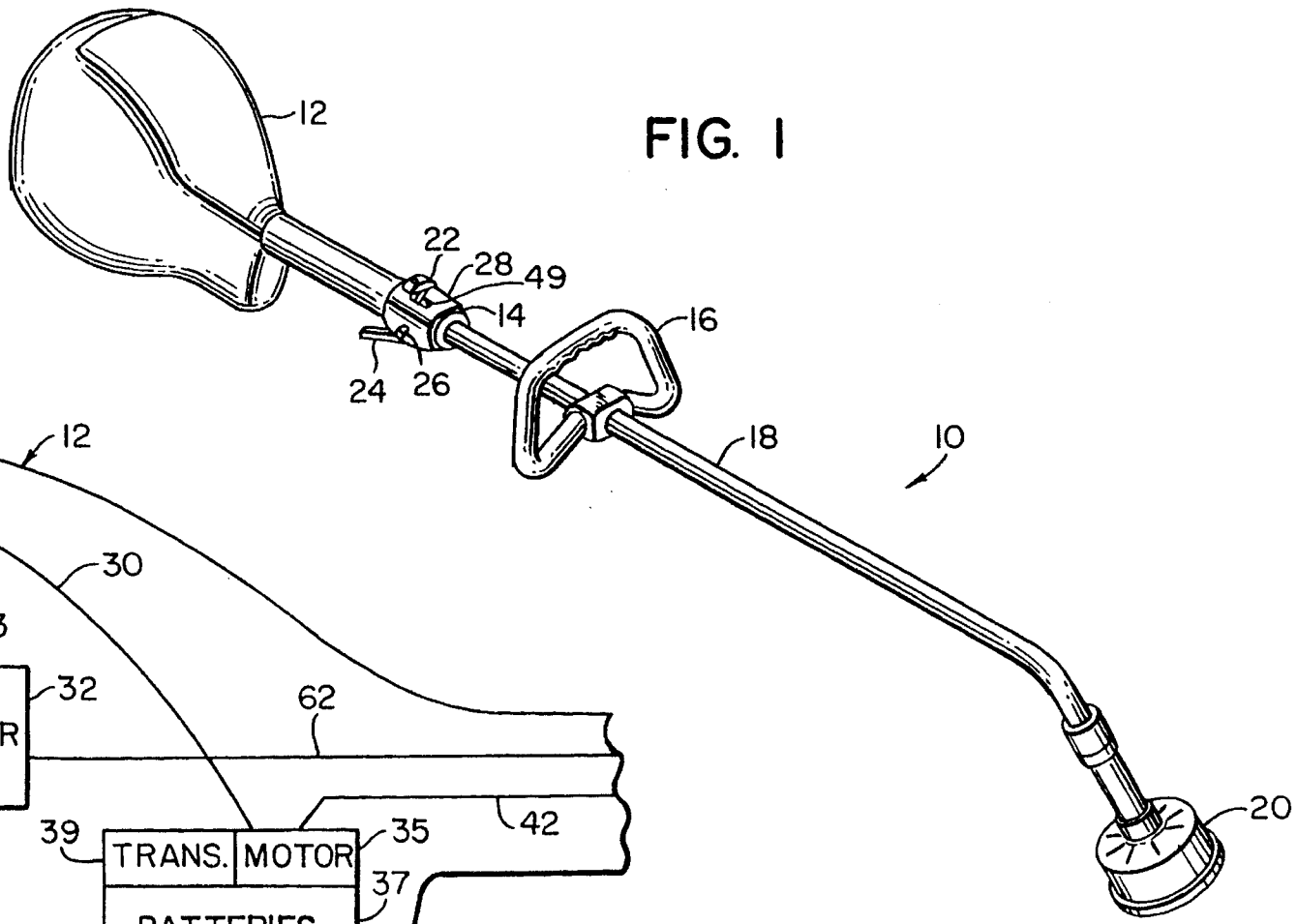
FIG. 1 is a perspective view of a string trimmer incorporating features of the present invention.

Referring to FIG. 1, there is shown a perspective view of a power tool 10 incorporation features of the present invention. Although the present invention will be described with reference to the single embodiment shown in the drawings, it should be understood that features of the present invention can be embodied in many different forms of alternate embodiments. In addition, any suitable size, shape or type of materials or elements could be used.

The power tool 10, in the embodiment shown, is a string trimmer for cutting vegetation. However, in alternate embodiments, features of the present invention could be incorporated into other types of power tools including hedge trimmers, lawn mowers, leaf blowers, or any other type of power tool. The string trimmer 10 generally comprises a power head 12, a user control section 14, a front handle 16, a shaft 18 and a cutting head 20. The front handle 16, shaft 18 and cutting head 20 are well known in the art and, therefore, will not be described further. The control section 14, in the embodiment shown, includes a start switch 22, a throttle actuator or lever 24 and an engine kill button 26.

Figure 3:
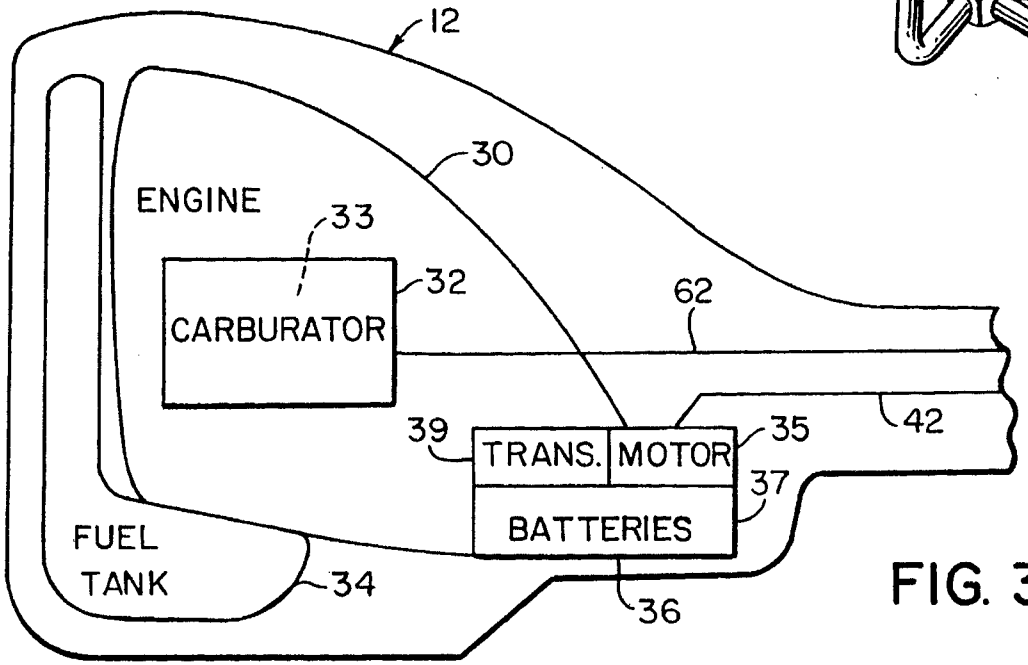
FIG. 3 is a schematic diagram of the power head of the string trimmer shown in FIG. 1.
Figure 2:
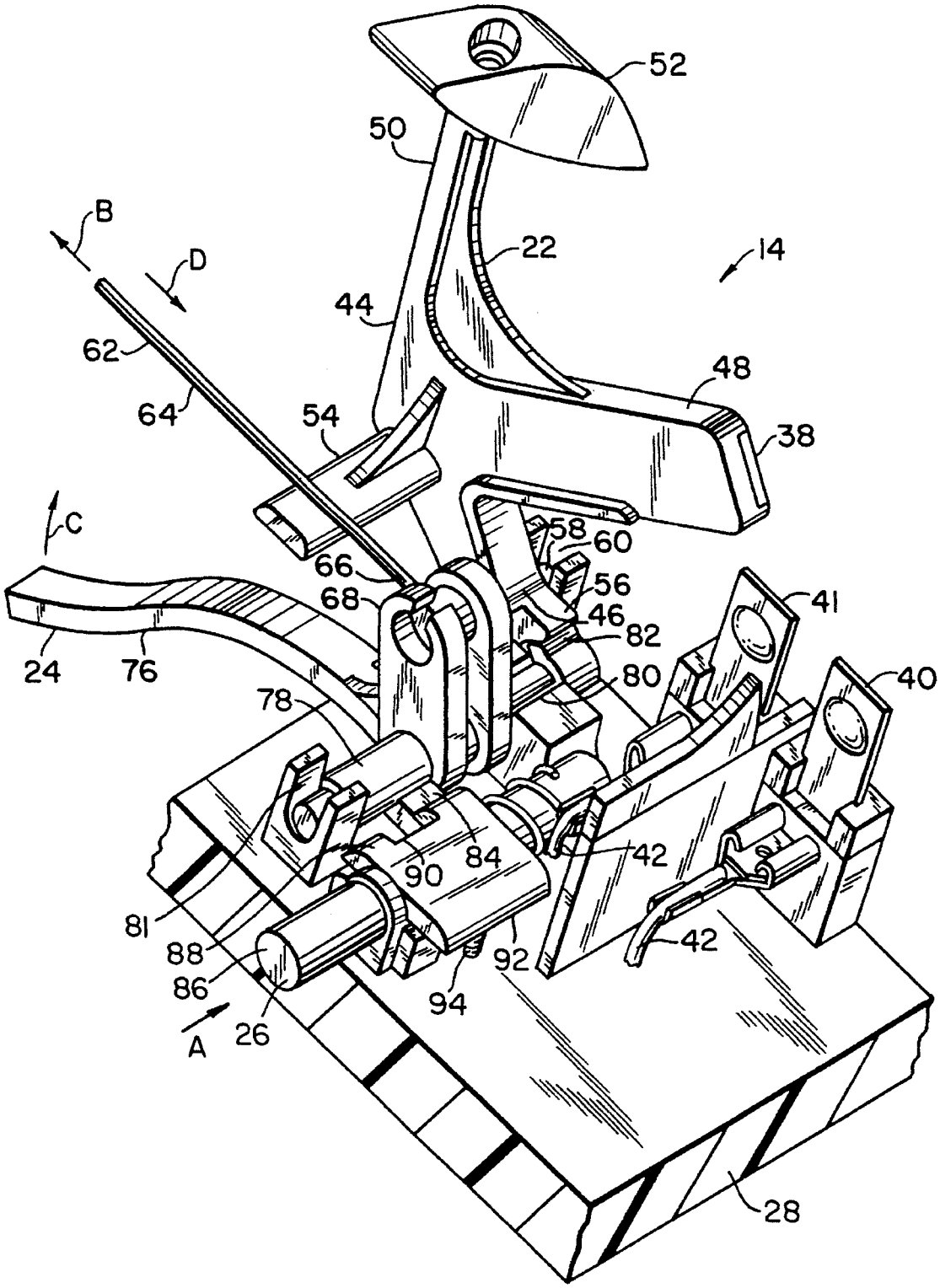
FIG. 2 is a perspective cut-away view of the user control section of the string trimmer shown in FIG. 1.

Referring also to FIG. 2, a cut-away perspective view of the components inside the housing 28 of the control section 14 is shown. The control section 14 is mounted on the shaft 18. However, in alternate embodiments, the control section could be located elsewhere or, components of the control section could be located in separate locations. The components at the control section 14 comprise portions of a starter assembly and a throttle control system. Referring also to FIG. 3, which is a schematic diagram of some of the general components of the power head 12, the starter assembly and throttle control system will be described. The power head 12 generally comprises a motor or internal combustion engine 30, a carburetor 32, a fuel tank 34, and an electric starter 36.

Figure 4A:
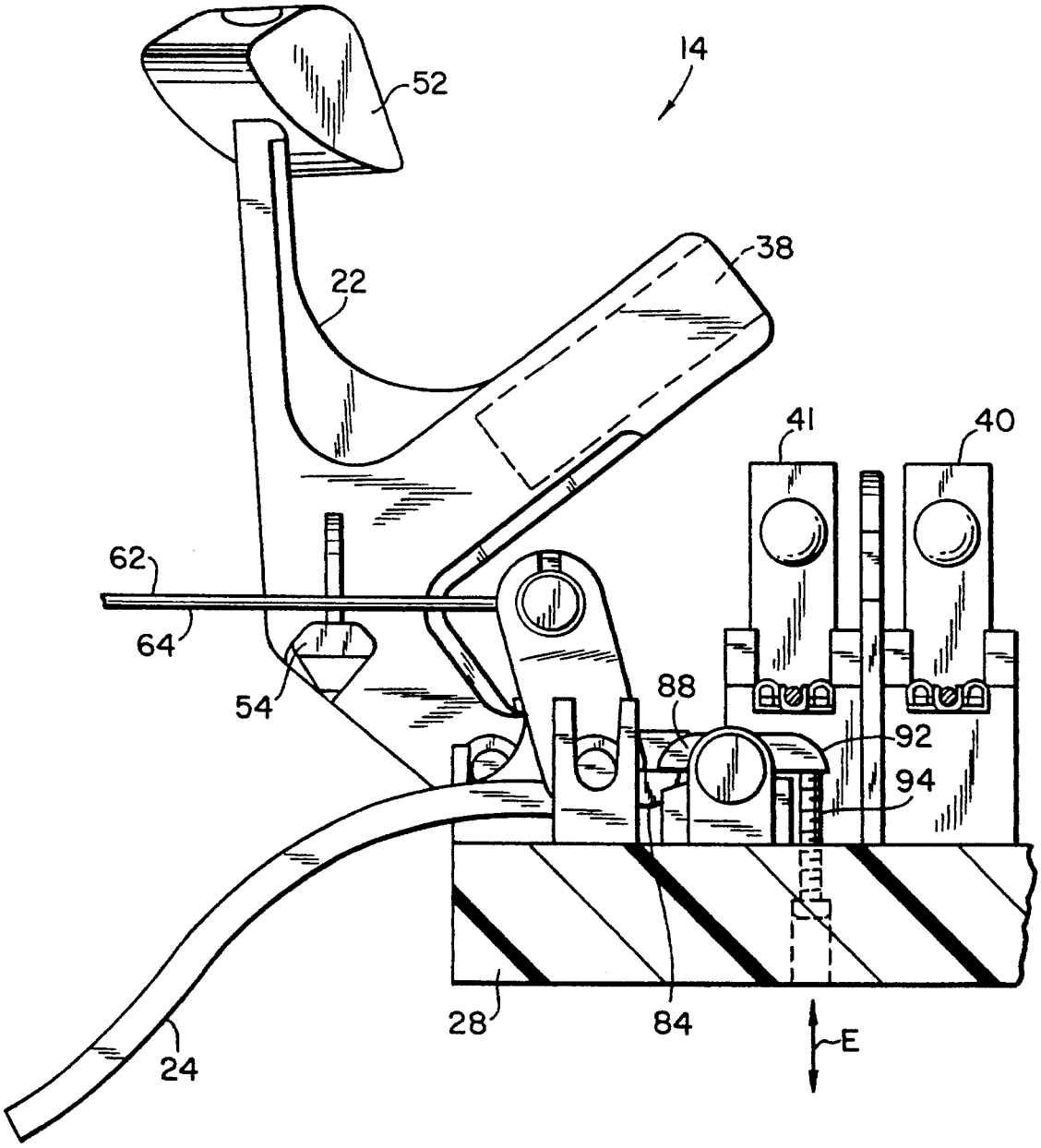
FIG. 4A is a schematic cut-away elevational side view of the components in the user control section shown in FIG. 2 at a first home position.
Figure 6A:
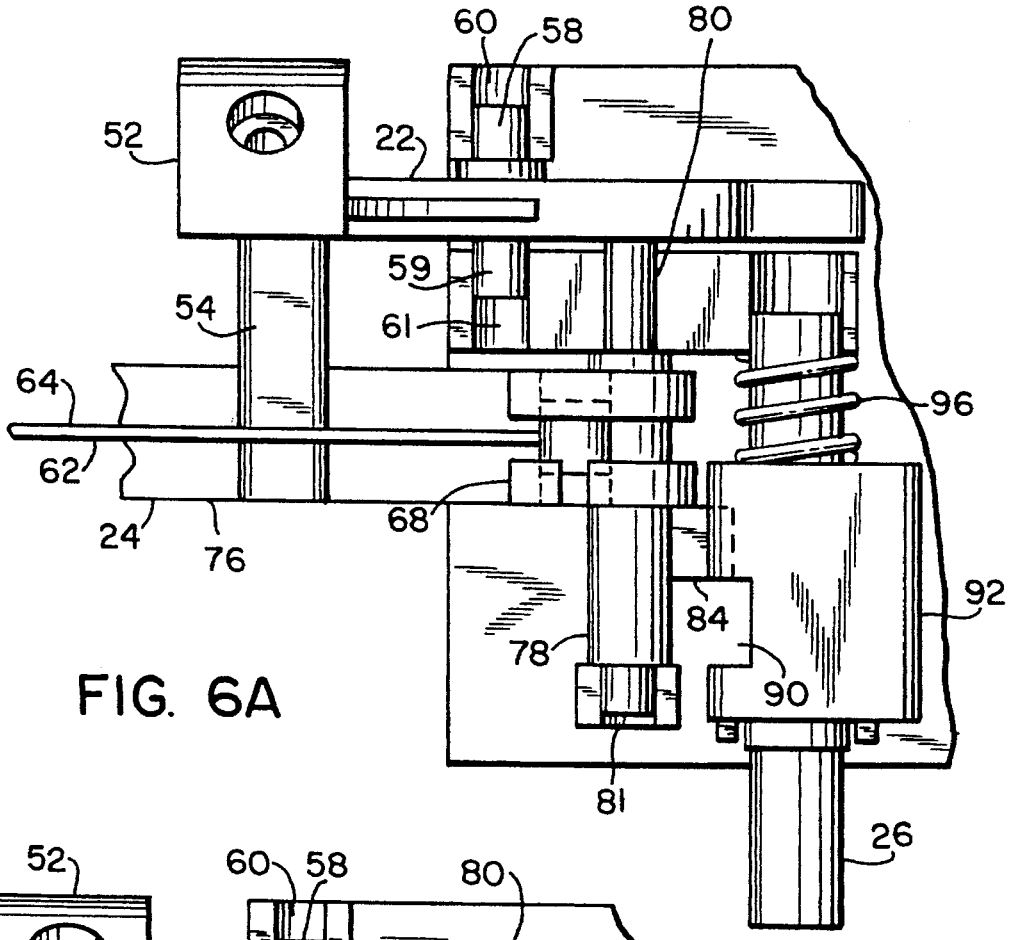
FIG. 6A is a cut-away plan top view of the components of the user control section in the home position shown in FIG. 4A.

Referring also to FIGS. 4A and 6A, the starter assembly generally comprises the start switch or lever 22, a pair of electrical contacts 40, 41, the electric starter 36 at the power head 12, and electric wire 42 extending between the starter 36 at the power head 12 and the contacts 40, 41 at the control section 14. The electric starter 36 includes an electric motor 35, a removable battery pack 37, and a belt drive transmission 39. Any suitable type of electric motor, batteries or transmission could be used. The start switch 22 (see FIG. 2) includes an electrical contact 38 for making electrical contact between the two contacts 40, 41. The contacts 40, 41 are fixedly mounted to a portion of the housing 28. The start switch 22 has a main body 44 with a first section 46 pivotably mounted to a portion of the housing 28, a second electrical contact section 48 with the contact 38 thereat, and a third section 50 having a finger contact section 52 mounted thereon. The finger contact section 52 is adapted to be contacted by a user to actuate the switch 22. Integrally formed with the main body 44 is a laterally extending cam-type lifter or over-travel actuator section 54. The first section 46 includes an interlock section 56. The third section 50 extends through a slot 49 in the housing 28 (see FIG. 1) with the finger contact section 52 located outside the housing 28. The slot 49 allows the switch 22 to be pivoted forward and backward relative to the housing 28. The first section 46 has two laterally extending pivot posts 58, 59 that are pivotably mounted at areas 60, 61 of the housing 28 (see FIGS. 4A and 6A). A spring (not shown) normally biases the switch 22 in the rearward position shown in FIG. 2. The main body 44 is preferably comprised of dielectric material, such as a molded polymer or plastic material. In alternate embodiments any suitable type of starter switch could be used. When the starter switch 22 is in its rearward non-start position, with the contact 38 spaced from the contacts 40, 41, the starter 36 is inactive. When a user pushes the finger contact section 52 forward, causing the switch 22 to pivot forward to the position shown in FIG. 4B, the contact 38 makes electrical contact with the contacts 40, 41 to act as a bridge between the two contacts 40, 41 to complete an electrical circuit. The starter 36 is thereby activated to cause the engine 30 start. The starter assembly has an interlock arrangement on the starter switch 22 to prevent the switch from being actuated unless the throttle trigger 24 is fully actuated by a user. This prevents accidental actuation of the starter assembly and, assists in a compression release as further understood from the description below.

Figure 3A:
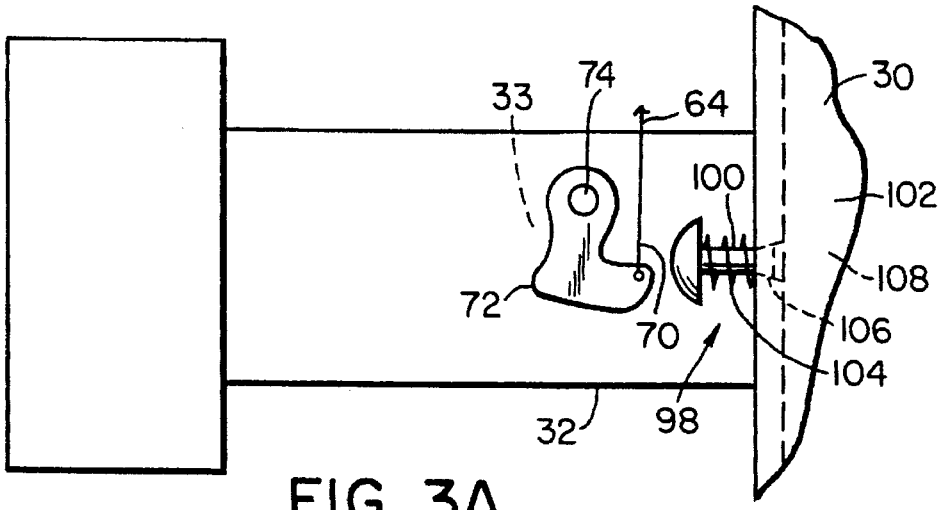
FIG. 3A is a schematic top view of a portion of the power head of the string trimmer shown in FIG. 1 showing a portion of a compression release system at a closed position and an actuator member attached to a throttle at the carburetor.

The throttle control system generally comprises a throttle control cable 62, the throttle lever 24, and the kill button 26. In the embodiment shown, the throttle actuator 24 is provided in the form of a finger actuated trigger. However, any suitable type of throttle actuator or cable mover could be provided. Any suitable type of control link, other than cable 62, could also be used. The cable 62 is generally well known in the art with an inner wire 64 and an outer sheath (not shown). As shown in FIG. 2, a first end 66 of the wire 64 is connected to a first section 68 of the throttle lever 24. As shown in FIG. 3A, an opposite second end 70 of the wire 64 is connected to a member 72 at the carburetor 32. The member 72 is fixedly connected to a shaft 74 of the throttle valve 33 such that when the member 72 is moved, the throttle valve 33 is moved. The throttle lever 24 also includes a second section 76 and a third shaft section 78. The second section 76 extends out a slot in the housing 28 and is adapted to be actuated by a user's finger. The shaft section 78 is pivotably mounted to the housing 28 at pivot mounts 80, 81 (see FIG. 6A) and includes an interlock section 82 at one end and a projection 84 at its front. The engine kill button 26 is slidably mounted to the housing in direction A shown in FIG. 2 and axially rotatably mounted on the housing. The button 26 has a finger contact end 86, a rear ledge 88 with a slot 90, and a front ledge 92. The finger contact end 86 extends out a hole in the housing 28 (see FIG. 1). The slot 90 is suitably sized and shaped to receive the front projection 84 of the throttle lever 24 therein when the button 26 is located at a throttle kill position (see FIGS. 4C and 6B). At a non-kill position (see FIGS. 2, 4A and 6A) the button 26 is suitably positioned relative to the throttle lever 24, and the rear ledge 88 is suitably sized and shaped, to restrain the projection 84 thereunder. Referring also to FIG. 4A, the throttle control system also includes an idle set screw 94. The screw 94 is adjustably connected to the housing 28 and contacts the bottom of the front ledge 92. In alternate embodiments, other suitably types or shapes of throttle actuators and/or throttle kill buttons or mechanisms could be provided. A different type of an idle speed adjuster, other than screw 94, could also be provided.

Figure 3B:
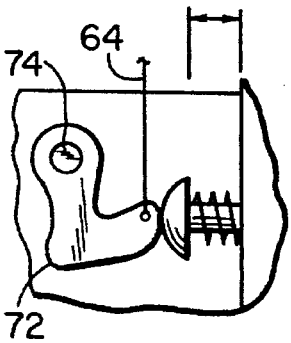
FIG. 3B is a schematic top view of the actuator member shown in FIG. 3A at a fully open throttle position.
Figure 5A:
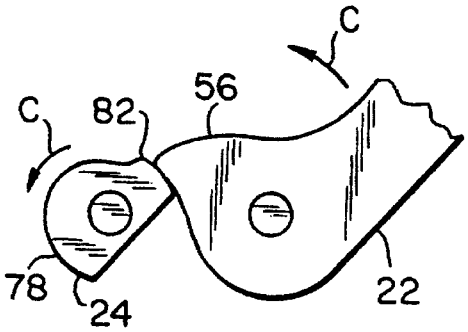
FIG. 5A is a schematic side view of a portion of the throttle lever and a portion of the start switch shown at a home position.

Referring to FIGS. 2, 3A, 4A, 5A and 6A the components of the control section 14 are shown at a home or throttle idle position. In this home position, the start switch 22 is biased by its spring (not shown) in its rearward position. As shown in FIGS. 2 and 5A, the interlock section 56 of the switch 22 is blocked from forward rotation by the interlock section 82 of the throttle lever 24. The interlock sections 56, 82 prevent the switch 22 from being rotated forward until the throttle lever 24 is moved, as further described below. The switch contact 38 is spaced from the contacts 40, 41. The throttle lever 24 is held at the position shown by two features. First, the throttle 33 at the carburetor 32 is biased by a spring (not shown), in a conventional manner, towards a fully closed position. Because the wire 64 is connected by the member 72 to the throttle valve shaft 74 (see FIG. 3A), the wire 64 is pulled or biased by the throttle spring in direction B to pull on the first section 68 of the throttle lever 24 in direction B shown in FIG. 2. Thus, the biasing action of the wire 64 on the lever 24 in direction B is the first feature that helps keep the lever 24 at its home position. The front projection 84 of the throttle lever 24 is biased against the bottom of the rear ledge 88 of the kill button 26. Because the kill button 26 is rotatably mounted to the housing, the front ledge 92 of the kill button 26 is thus biased against the idle set screw 94. Hence, the second feature that holds the throttle lever 24 in the home position is the idle set screw 94 by means of the kill button 26 and the projection 84. In this home position, the wire 64, throttle lever 24, kill button 26 and set screw 94 keep the spring biased throttle valve 33 at the carburetor 32 partially open idle position. A user can depress or move the second section 76 of the throttle lever 24 in direction C shown in FIG. 2 to move the wire 64 forward in direction D. This opens the carburetor throttle valve further to increase the speed of the engine 30. FIG. 3B shows the position of the member 72 when the throttle lever 24 has been fully depressed. The member 72 moves the throttle valve shaft 74 to its fully open position. When the user releases the throttle lever 24, the spring (not shown) at the carburetor 32 pulls the wire 64 back to its home position. This, in turn, returns the throttle lever 24 back to its home position.

With the arrangement described above, the user can adjust the idle set screw 94 to set the idle speed of the engine 30. The idle set screw 94 forms a stop limit to the axial rotation of the engine kill button 26. By adjusting the idle set screw either up or down in direction E, shown in FIG. 4A, the stop limit to the axial rotation of the button 26 can be adjusted. By adjusting the axial rotation limit for the button 26, the axial rotation limit of the lever 24, at least in one direction, is adjusted. This is because of the interaction between the projection 84 and rear ledge 88. This, in turn, adjusts the position of the wire 64 at the home or idle position to set the member 72 and throttle valve shaft 74. This sets the position of the throttle valve 33 at the carburetor 32 to a desired partially open position to run the engine 30 at idle speed.

Figure 3C:
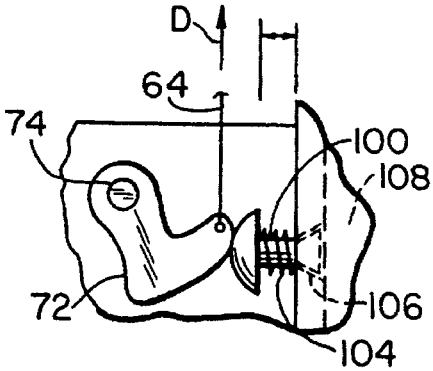
FIG. 3C is a schematic top view of the actuator member shown in FIG. 3B at an over-travelled position and actuating the compression release system to an open position.
Figure 3D:
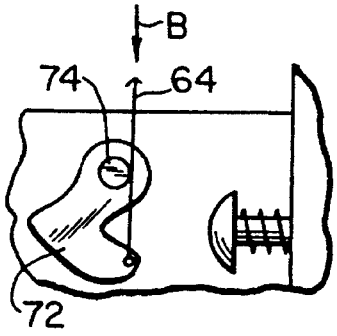
FIG. 3D is a schematic top view of the actuator member shown in FIG. 3B at a throttle fully closed position.
Figure 4B:
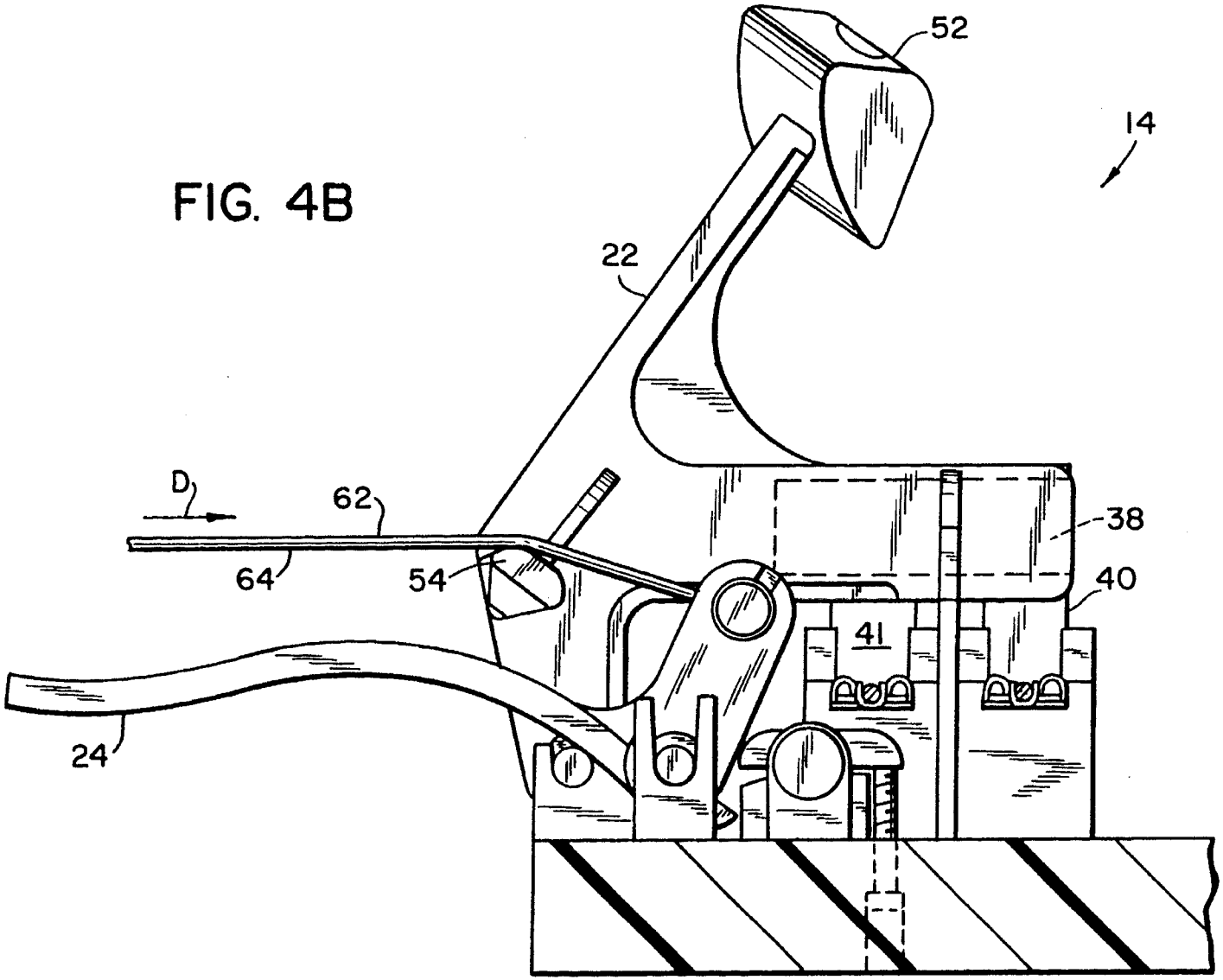
FIG. 4B is an elevation cut-away side view of the components as in FIG. 4A shown at a start position.
Figure 4C:
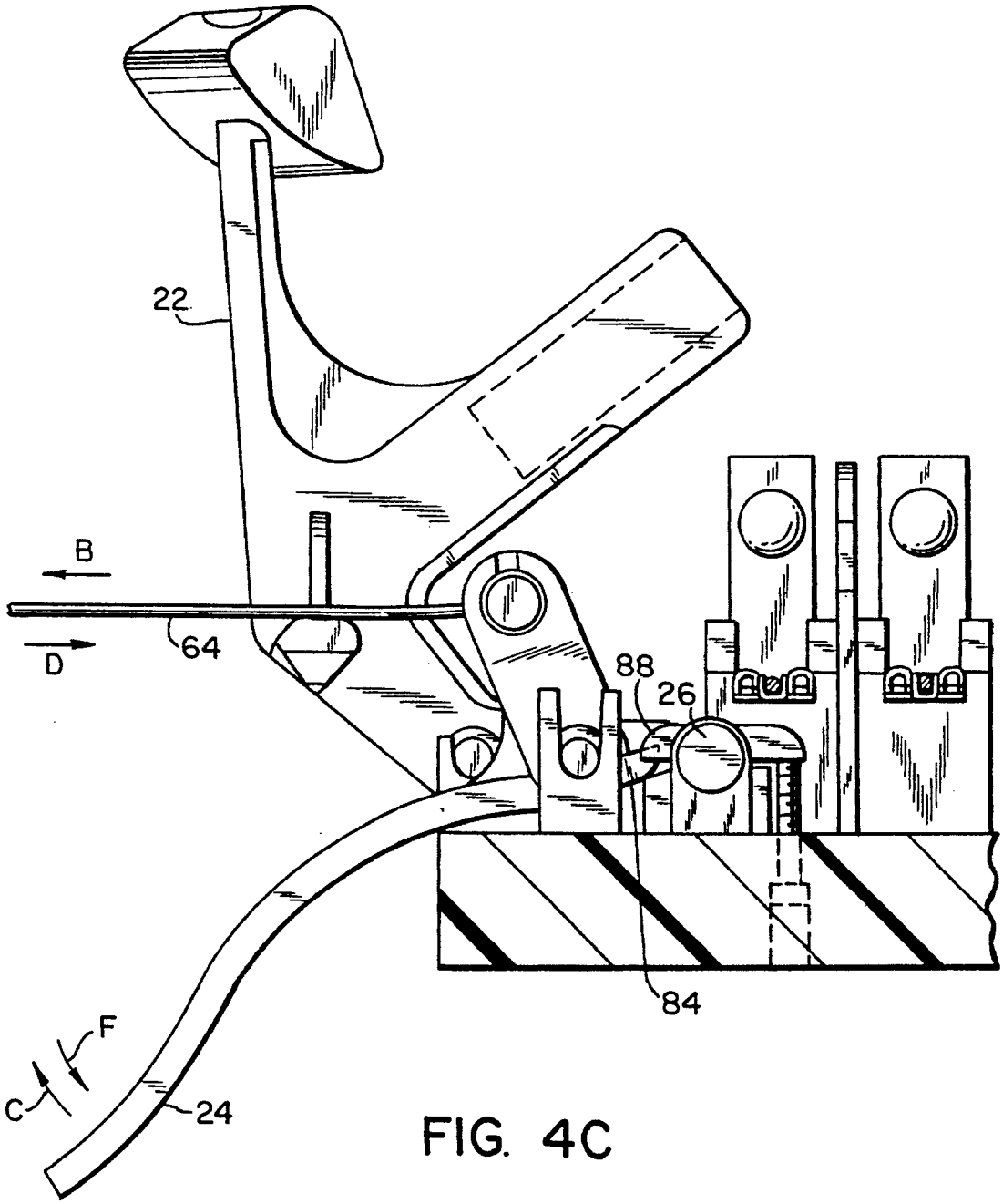
FIG. 4C is an elevation cut-away side view of the components as shown in FIG. 4A shown in an engine kill position.
Figure 6B:
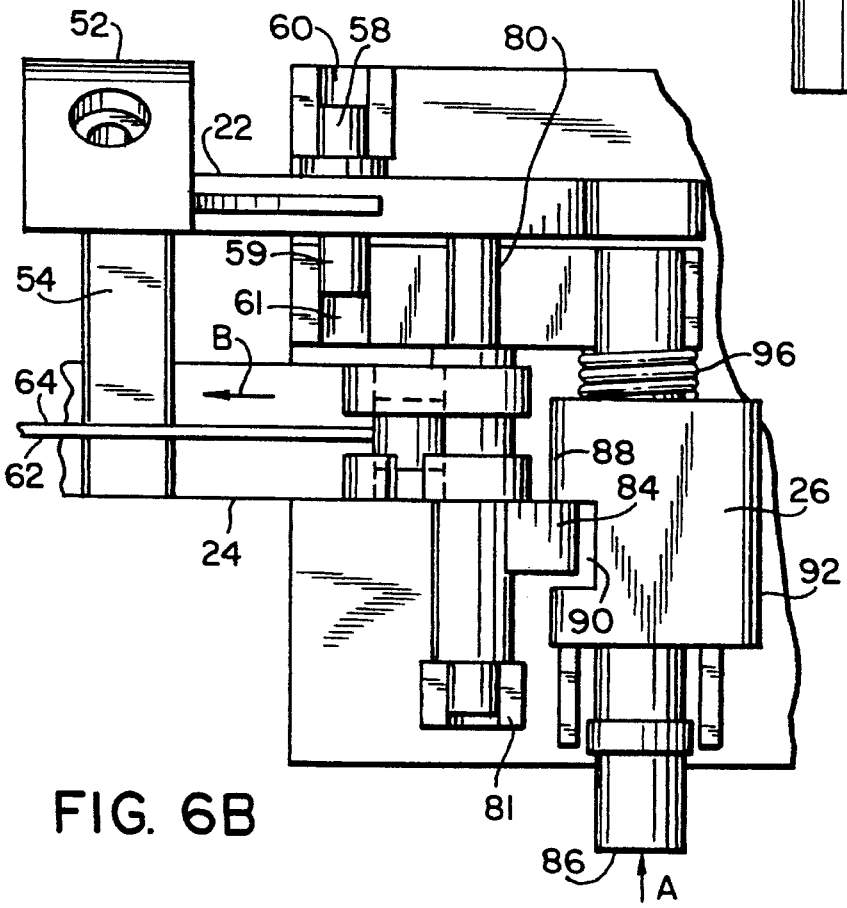
FIG. 6B is a cut-away plan top view of the components shown in FIG. 6A at the engine kill position shown in FIG. 4C.

In order to stop or kill the engine 30, a user merely depresses the engine kill button 26 in direction A. Referring to FIGS. 4C and 6B, as the button 26 axially slides in direction A, the spring 96 is compressed and the slot 90 in the rear ledge 88 comes into registry with projection 84 of the throttle lever 24. As noted above, because the throttle valve at the carburetor 32 is partially open when the throttle control system is at its home position, the wire 64 pulls in direction B. Because of the registry between slot 90 and projection 84, the wire 64 is able to move in direction B past its home or idle position. The projection 84 moves into slot 90 with the throttle lever 24 rotating backwards in direction F to a fully closed throttle position. With the throttle lever 24 and wire 64 in their fully closed throttle position, the throttle valve spring at the carburetor is able to fully close the throttle valve. FIG. 3D shows the position of the member 72 and shaft 74 when the throttle valve spring is able to pull the wire 64 past its idle position. With the throttle valve fully closed, engine 30 is choked, due to a lack of a proper air/fuel mixture to thereby stop the engine. When it is desired to start the engine 30 again, the user moves the throttle lever 24 upward in direction C. This, in turn, moves the wire 64 in direction D to move the throttle valve 33 back to its partially open idle position. As the top of the projection 84 rotates under the bottom of the rear ledge 88 of the kill button 26, the spring 96 axially slides the kill button 26 back to its home position shown in FIGS. 2 and 6A. The projection 84 is thus located under the rear ledge 88 again and, once again prevents the throttle control system from moving to an engine kill position unless the kill button is depressed by a user. In alternate embodiments, other types of means for stopping the engine 30 could be used including an electronic kill system. The components of the throttle control system could also be modified by a person skilled in the art. The kill button 26 functions as a throttle lever control member to control, at least partially, the position of the throttle lever 24. The button 26 has its first position (FIG. 6A) relative to the throttle lever 24 for adjustably stopping movement at an idle position and, a second throttle lever release position (FIG. 6B) for allowing the throttle lever 24 to move past the idle position to the engine stop position.

Figure 5B:
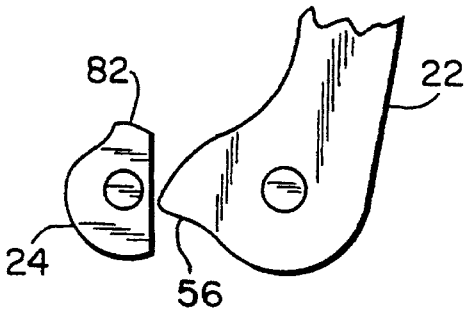
FIG. 5B is a schematic side view of the portions shown in FIG. 5A at a second start position.

In order to use the starter assembly to start the engine 30, a user must first fully depress the throttle lever 24. In an alternate embodiment, the throttle lever 24 need not be fully depressed in order to start the engine. As seen in FIGS. 5A and 5B, fully actuating or depressing the lever 24 rotates the shaft section 78 of the lever 24 in direction C to move the interlock section 82 out of the path of the interlock section 56 of the start switch 22. A user can now push the finger contact section 52 of the start switch 22 forward. The switch 22 rotates in direction C with the interlock section 56 passing by the interlock section 82. With the throttle lever 24 fully depressed, the member 70 (see FIG. 3B) at the carburetor is moved to a wide open throttle position adjacent the plunger 100, but not opening the compression release system 98. As the switch 22 is rotated forward to the start position shown in FIG. 4B, the contact 38 on the switch 22 contacts the two contacts 40, 41 to complete an electrical circuit from the batteries 37 to the electrical motor 35. With electrical power now being supplied to the electric motor 35 from the batteries 37, the starter is activated to drive the engine 30 via the belt transmission 39. Unless the throttle actuator 24 is located at its fully actuated position, engagement of the interlock sections 56, 82 with each other prevent the start switch from being moved forward. When the engine 30 starts, the user releases the start switch 22. The start switch spring (not shown) biases the start switch back to its home position shown in FIG. 4A. With the contact 38 removed from the contacts 40, 41, the electrical circuit from the batteries 37 to the motor 35 is broken. The electric starter 36 is thus deenergized.

In order to conserve battery power of the starter assembly, the present invention automatically uses the compression release system 98 during starting of the engine 30 to make it easier for the starter 36 to drive the engine 30. Referring now to FIGS. 3A–3C, the engine 30 generally comprises the compression release system 98. The compression release system 98 includes the plunger 100 movably mounted to a cylinder 102 of the engine 30. The plunger 100 is biased by a coil spring 104 in the closed position shown in FIG. 3A. The cylinder 102 has a compression release hole 106 that extends into the combustion chamber 108 of the cylinder 102. The plunger 100, in the closed position shown in FIG. 3A, substantially blocks the hole 106. However, as shown in FIG. 3C, the plunger 100 can be depressed or moved, by compressing the spring 104, to open a path through the hole 106 from the combustion chamber 108 to the atmosphere. The attributes of compression release systems are well known in the art as seen in U.S. Pat. Nos. 4,204,384; 2,742,380 and 4,619,228 which are hereby incorporated by reference in their entirety. In alternate embodiments, other types of compression release systems could be used in addition to or as an alternative to the system 98 or, no compression release system need be provided. Because the electric motor 35 of the starter 36 encounters less physical resistance to driving the engine 30 with the compression release system open or actuated, the electric motor 35 uses less power from the batter pack 37. The battery pack 37 can thus be smaller, lighter, last longer between charges, and have a longer work-life than a power tool that did not have the compression release system.

In order to accomplish automatic compression release during starting, the start switch 22 uses its over-travel actuator section 54 to contact and move the wire 64 an over-travel distance or extension. As seen in FIG. 4B, the actuator section 54 moves the wire 64 when the switch 22 is pushed forward. As noted above, the throttle lever 24 needs to be fully depressed before the switch 22 can be moved forward to a start position. Because the member 70 is already adjacent the plunger 100, as seen in FIG. 3B, when the actuator section 54 contacts and moves the wire 64, the wire 64 moves the member 70 an over-travel rotation of about 20°. This over-travel rotation is sufficient to cause the member 70 to actuate the compression release system 98 by pushing the plunger 100 inward to an open position as seen in FIG. 3C. Thus, the member 70 functions as a cam member or over-travel actuation member for the compression release system 98. The compression release system 98 is automatically actuated when the start switch 22 is moved to its start position. After the engine 30 starts, the user releases the start switch 22. The start switch spring (not shown) moves the start switch back to its home position. The actuator section 54, thus, disengages from the wire 64 thereby ending over-travel extension of the wire 64. With the over-travel extension complete, the compression release system 98 returns to its normally closed position shown in FIG. 3A. The compression release is temporary. It is only actuated during starting of the engine 30. The rotation of the throttle valve shaft 74 past its fully open or wide open position shown in FIG. 3B to its over-travel position shown in FIG. 3C does not significantly impede or diminish the fully open effect of the throttle.

The features described above could be modified. The over-travel provided with the control cable 62 could be used to alternatively or additionally actuate other devices or elements. In normal non-starting operation, the cable actuator trigger or throttle lever 24 is adapted to rotate through a fixed angular displacement between the idle position and its fully actuated position. This motion is translated to the actuator cable 62 and then to the actuator member 70 on the carburetor 32. The actuator member 70 rotates the throttle valve between idle and wide open throttle positions. Thus, the single control cable 62 performs a first function by controlling the operational position of the throttle. By use of the cam-type lifter or over-travel actuator section 54 on the start switch 22, the single control cable 62 also performs a second function when it is moved an over-travel distance past the wide open throttle position; namely, actuation of the compression release system. The single control cable 62 also performs a third function by functioning as a link for controlling the idle speed setting of the throttle valve. In addition, the single control cable 64 also performs a fourth function as a link in stopping the engine by allowing the throttle valve to move to a fully closed position. Thus, the single control cable assists in controlling four features of the power tool. This can make the power tool less expensive to manufacture, assemble, and repair.

It should be understood that the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. In a power tool having a user control section, an internal combustion engine with a throttle valve, and a compression release system, the improvement comprising:

a single control cable connected between the control section and the engine, the cable being adapted to control the position of the throttle valve, actuation of the compression release system, and stopping of the engine.

2. A power tool as in claim 1 wherein the cable has a first range of movement for normal operation of the power tool, a second range of movement different from the first range of movement for actuating the compression release system, and a third range of movement different from the first and second ranges of movement for causing the engine to stop operating.

3. A power tool as in claim 1 wherein the cable is connected to a shaft of the throttle valve and, the shaft has a cam member thereon for actuating the compression release system when the cable rotates the shaft to a predetermined position.

4. A string trimmer comprising:

an internal combustion engine having a throttle; and a control system having a throttle actuator, a control cable operably connected between the throttle actuator and the throttle for controlling speed of the engine, and means for actuating a first auxiliary function on the engine when the cable is moved to a first predetermined position, wherein the first predetermined position is past a throttle fully open position of the cable.

5. A string trimmer as in claim 4 further comprising means for actuating a second auxiliary function on the engine when the cable is moved to a second predetermined position.

6. A string trimmer as in claim 5 wherein the second predetermined position is a throttle valve fully closed position that is past a throttle idle position.

7. In a string trimmer having an internal combustion engine, a throttle actuator, an electric starter and a start switch, the improvement comprising:

means for preventing the start switch from being actuated unless the throttle actuator is located at a predetermined actuated position, wherein the means for preventing includes a first section on the throttle actuator that is located, at least partially, in a path of a second section on the start switch into the throttle actuator is moved to its predetermined actuated position.

8. A string trimmer as in claim 7 wherein the first interlock section is pivotably mounted to a control section housing of the string trimmer in front of the second interlock section.

9. A string trimmer as in claim 7 wherein the throttle actuator includes a first section connected to a control cable, a second section adapted to be contacted by a user, and a front projection.

10. In a power tool having an internal combustion engine with a throttle valve, and a throttle valve control system with a user actuated throttle lever and a control link between the throttle valve and the throttle lever, the improvement comprising:

a throttle lever control member movably connected to the throttle lever, the throttle lever control member having a first position relative to the throttle lever for adjustably stopping movement of the throttle lever in a predetermined direction at an idle position and a second throttle lever release position for allowing the throttle lever to move past the idle position in the predetermined direction to an engine stop position, wherein the throttle lever has a projection adapted to be stopped by the control member at the first position and, the control member has an aperture to allow the projection to move past the idle position when the control member is at its second position.

11. A power tool as in claim 10 wherein the throttle lever control member is axially rotatably and axially longitudinally slidably mounted on a housing of a user control section.

12. A power tool as in claim 11 further comprising an idle set screw connected to the housing and adapted to adjustably stop axial rotation of the throttle lever control member on the housing at a desired position.

13. A power tool as in claim 12 wherein the throttle lever is pivotably mounted to the housing and is biased by the control link in a predetermined direction.

14. A string trimmer having a user control section, the control section comprising:

a housing;

a throttle actuator movably connected to the housing, the throttle actuator being adapted to be moved by a user;

means for adjustably limiting position of the throttle actuator on the housing while at an idle position, the means for adjustably limiting including a throttle actuator control member movably mounted to the housing and having a stop surface for contacting and stopping a portion of the throttle actuator; and means for allowing the throttle actuator to move beyond the idle position to an engine choke position, wherein the means for allowing includes the stop surface having a slot for allowing the portion of the throttle actuator to pass therethrough.

15. A string trimmer as in claim 14 wherein the throttle actuator control member is both axially longitudinally slidably and axially rotatably movable on the housing.

16. A string trimmer as in claim 14 wherein the means for adjustably limiting includes an idle set screw connected to the housing.

17. In a power tool having a user control section, an internal combustion engine with a throttle valve, and a compression release system, the improvement comprising:

a single control cable connected between the control section and the engine, the cable being adapted to control the position of the throttle valve, actuation of the compression release system, and stopping of the engine, wherein the cable is connected to a shaft of the throttle valve and, the shaft has a cam member thereon for moving a portion of the compression release system when the cable rotates the shaft to a predetermined position.

* * * * *